United States Patent [19]

Nagano

[11] 4,403,718

[45] Sep. 13, 1983

[54] METHOD AND APPARATUS FOR AUTOMATICALLY CONTROLLING TRAVEL OF TWO PLASTICS FILM STRIPS AS A BAG MATERIAL OR THE LIKE

[75] Inventor: Mitsuo Nagano, Kawanoe, Japan

[73] Assignee: Taiyo Shokai Co., Ltd., Japan

[21] Appl. No.: 312,132

[22] Filed: Oct. 16, 1981

[30] Foreign Application Priority Data

Oct. 17, 1980 [JP] Japan ..... 55-144368

[51] Int. Cl.[3] ..... B65H 23/00; B65H 23/10; B65H 23/04

[52] U.S. Cl. ..... 226/27; 226/2; 226/38

[58] Field of Search ..... 226/2, 27, 28, 29, 33, 226/38, 39; 156/290

[56] References Cited

U.S. PATENT DOCUMENTS

| | | | |
|---|---|---|---|
| 3,556,509 | 1/1971 | Crum | 226/28 X |
| 3,816,210 | 6/1974 | Aoka et al. | 226/2 X |
| 4,011,975 | 3/1977 | Brown, Jr. | 226/33 X |

FOREIGN PATENT DOCUMENTS

| | | | |
|---|---|---|---|
| 1236491 | 6/1971 | United Kingdom | 226/27 |

*Primary Examiner*—Stuart S. Levy
*Assistant Examiner*—Lloyd D. Doigan
*Attorney, Agent, or Firm*—McGlew and Tuttle

[57] ABSTRACT

This invention provides an improved method and apparatus for automatically controlling travel of two transversely spaced parallel plastics film strips in a bag-making machine or the like that can correct rapidly the relative positional gaps produced between the register marks on the strips by means of a new retarding device for the strips as incorporated in the apparatus.

3 Claims, 5 Drawing Figures

METHOD AND APPARATUS FOR AUTOMATICALLY CONTROLLING TRAVEL OF TWO PLASTICS FILM STRIPS AS A BAG MATERIAL OR THE LIKE

BACKGROUND OF THE INVENTION

1. Field of the Invention

This invention relates to a method of and apparatus for automatically controlling travel of two film strips of a thermoplastic synthetic resin, such as vinyl or polyethylene, as a bag or package material, which are intermittently moved by an intermittent conveyor means, and more particularly to such method and apparatus that can be applied to a method and machine for manufacturing bags from such material and/or for packaging articles with the material.

2. Description of the Prior Art

It is well known that in machines for manufacturing bags or the like from two plastics film strips, such strips are processed by processing devices such as a heat-sealing device and a cutting device at each inoperative interval of the intermittent conveyor means of the nipper type which comprises a pair of rollers. As the film strips are moved in transversely spaced parallel relationship by such conveyor means, it occurs necessarily that either one of the strips goes ahead of the other, thereby producing relative positional gaps or discrepancies between the paterns, letters, trademarks and the like which are printed on the strips at regular intervals. Such gaps or discrepancies tend to become larger and larger as the machine is continuously operated. Accordingly, if and when the strips are processed by the processing devices without correcting such gaps or discrepancies, a considerable amount of incomplete or defective materials are produced.

In a conventional method and apparatus for controlling travel of the two transversely spaced parallel film strips, travel of the strips is controlled in such a way that either one of the strips that goes ahead of the other is retarded by an electromagnetic retarding device for the strip which is arranged to be actuated in response to detection by a sensor of the register marks which are indicated on the strip. With such a way of control, however, the relative positional gaps or discrepancies between the register marks on the travelling strips cannot be rapidly and effectively corrected, since the amount of retardation of a travelling film strip obtained in such a way is very small relative to the distance for which the strip is moved at a time by the intermittent conveyor. In fact, if the machine is of the type which can transport the strips for 20 cm, the amount of retardation of each of the strips obtained by such retarding devices is to the order of 1 mm. Accordingly, if there is a relative positional gap of 5 mm to 10 mm long between the register marks on the strips, the retarding force must be frequently applied to the preceding strip by the retarding device in order that the relative positional gaps between the register marks on the strips can be corrected. Thus, in accordance with the conventional method and apparatus, waste of material cannot be avoided.

SUMMARY OF THE INVENTION

The present invention is intended to eliminate the drawbacks indicated with such conventional method and apparatus and to provide an improved method and apparatus for automatically controlling travel of the two transversely spaced parallel film strips which can rapidly and effectively correct the relative positional gaps or discrepancies to be produced between the register marks on the strips and which can not only avoid waste of the material, but also efficiently and precisely process the film strips.

Other objects and advatageous features of the present invention will become apparent from the following description.

DESCRIPTION OF THE PREFERRED EMBODIMENT

Figure 1:
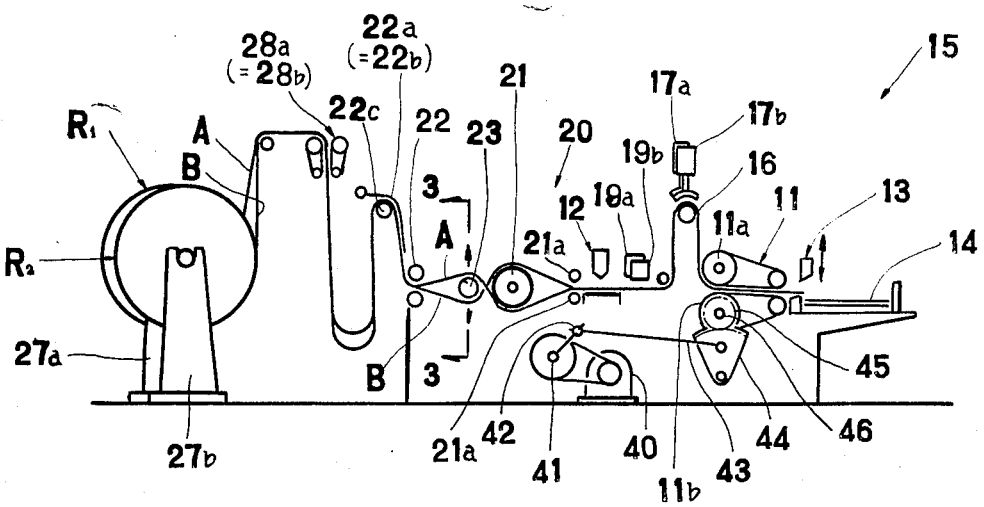
FIG. 1 is a diagrammatic side view of one embodiment of the present invention as applied to a bag-making machine.
Figure 2:
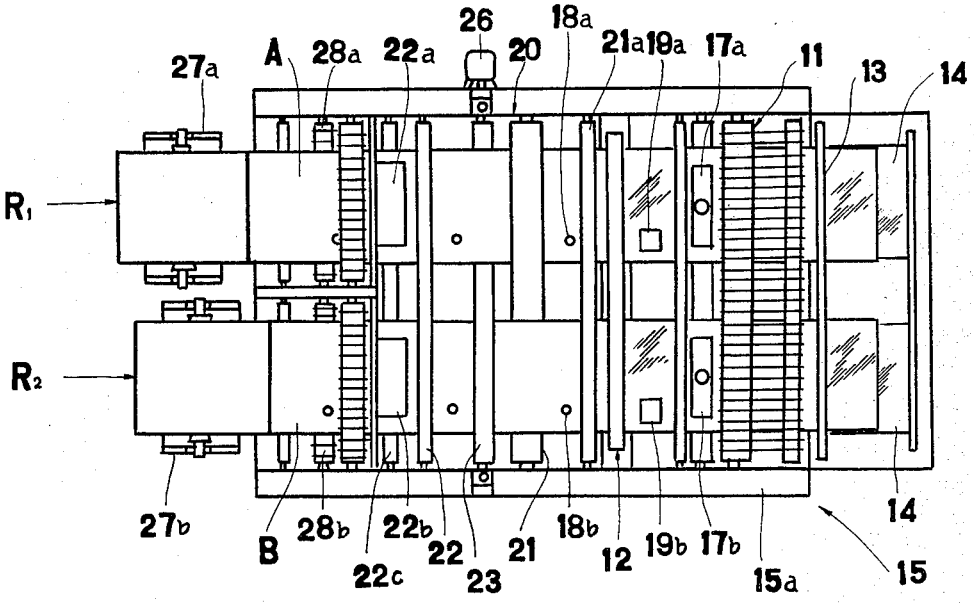
FIG. 2 is a plan view of the embodiment shown in FIG. 1.

The method and the apparatus according to the present invention will now be described in further detail with respect to embodiments in connection with the accompanying drawings.

Like portions or parts are indicated by like numerals and characters throughout the specification and drawings.

In the embodiment of the present invention, an intermittently operated conveyor means 11 of a nipper type which comprises a pair of intermittent rollers 11*a* and 11*b* is provided on the frame 15*a* of a bag-making machine 15. The intermittent conveyor means 11 is driven by a motor 40 through the medium of a crank mechanism which comprises a main shaft 41 continuously rotated by the motor, a crank 42 fixedly mounted on the main shaft, a crank rod 43 connected at one end to the crank 42 and at the other end to a segmental gear 44 and a pinion 45 fixedly mounted on a driven shaft 46 and in meshed engagement with the teeth of segmental gear 44, said driven shaft being in alignment with and connected to the shaft of roller 11*a* by means of a one-way clutch, not shown.

As the conveyor means 11 is rotated, two transversely spaced parallel film strips A and B as bag materials which are slidably nipped between the two rollers 11*a* and 11*b* are intermittently moved for a certain distance at a time corresponding to the length of a single bag. Indicated by numerals 12 and 13 are a common heat-sealing device and a common cutting device for the strips A and B that are provided upstream of and downstream of the conveyor means 11, respectively. These devices 12 and 13 are respectively arranged to be operated for manufacturing bags 14 at each inoperative interval of the conveyor means 11.

Between the heat-sealing device 12 and the conveyor means 11 are provided photoelectric mark detectors 19*a* and 19*b* which are arranged to detect register marks 18*a* and 18*b* which are indicated on the film strips A and B at regular intervals. Provided between the detector means and the conveyor means are a guide roller 16 for the strips A and B and first retarding devices 17*a* and 17*b* for retarding advance of the strips A and B, respectively. Each of the said retarding devices 17*a* and 17*b* includes an electromagnetic means and a spring means and is arranged to retard advance of each strip by pressing it against a surface of the guide roller 16. In the illustrated embodiment, each said first retarding device is constructed such that when a solenoid of the electromagnetic means is deenergized, the retarding action is actuated by the action of a spring means, whereby travel of each strip is retarded.

Indicated by reference numeral 20 and provided on the strip-feeding side of the heat-sealing device 12 is a second retarding device which is arranged to continuously and relatively impart a retarding force to the two film strips A and B so as to operate such that if and when the retarding force or load imparted to one A or B of the two strips is stepwise raised, the retarding force or load imparted to the other B or A of the two strips is stepwise lowered, conversely.

The second retarding device 20 comprises a fixed, round guide bar 21 of relatively large diameter and a guide roller 22, which define paths of travel of the two strips A and B, and a round bar 23 as a retarding member for the strips that extends transversely across said paths between the guide bar 21 and the guide roller 22 and is arranged to be movable stepwise in the direction substantially perpendicular to said paths so that the device 20 can perform the functions mentioned in the preceding paragraph.

Figure 3:
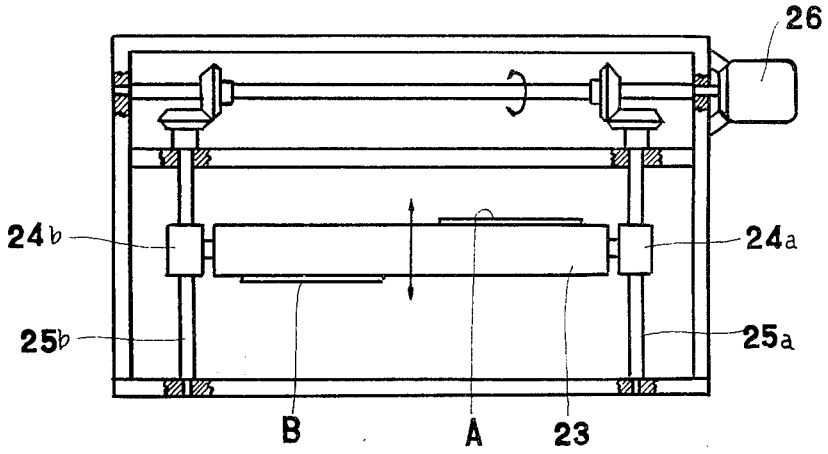
FIG. 3 is an enlarged schematic view, seen in the direction of arrows of the line 3—3 in FIG. 1, of a main partion of a second retarding device for film strips.

In the illustrated embodiment, as schematically illustrated in FIG. 3, the round bar 23 is provided, at its ends, with threaded extension 24*a* and 24*b* which are engaged with a pair of threaded bars 25*a* and 25*b* which extend vertically and which are operatively connected with a reversible motor 26 so that when the motor 26 is rotated, the round bar 23 is caused to move upwardly or downwardly along the vertically extending threaded bars 25*a* and 25*b* and so that as the motor 26 is stopped, the round bar 23 is caused to be held on the threaded bars 25*a* and 25*b*.

Indicated by numeral 22*c* and provided on the strip-feeding side of the guide roller 22 is a guide roller. Between the guide bar 21 and the heat-sealing device 12 are a pair of guide rollers 21*a* and 21*a*.

Located at one end of the machine 15 are two supports 27*a* and 27*b* for rotatably supporting rolls R1 and R2 of film strips A and B as bag material, respectively. On the delivery side of the roll supports 27*a* and 27*b* there are provided two strip-drawing devices 28*a* and 28*b*.

To prepare operation of the apparatus of the present invention, the film strips A, B are drawn from the supply rolls R1, R2 supported on the supports 27*a*, 27*b* and are fed through the strip-drawing devices 28*a*, 28*b*, over the guide roller 22*c* and under the guide roller 22, then one A or B of the strips is fed over the round bar 23 and under the guide bar 21, and the other B or A of the strips is fed under the round bar 23 and over the guide bar 21, and then both of the strips A, B are nipped between the two rollers 11*a*, 11*b* of the conveyor means 11 after being passed through the pair of the guide rollers 21*a*, 21*a*, the heat-sealing device 12 and the two first retarding devices 17*a*, 17*b*, respectively. In this case, it is desirable that the strips A, B are arranged so that the register marks 18*a*, 18*b* are transversely aligned with each other, approximately. It is also desirable that the strips A, B which extend from the supply rolls R1, R2 to the conveyor rollers 11*a*, 11*b* are properly tensed, particularly at their portions upstream of the guide bar 21 so that the effect of controlling transport or travel of the strips A and B can be surely obtained. In the illustrated embodiment, to give proper tension to such portions, two pieces 22*a*, 22*b* of textile of suitable weight one ends of which are secured to the machine frame 15*a* at its portions adjacent to the guide roller 22*c* are to be respectively superimposed upon the film strips A, B, which pass over the roller 22*c*, whereby relatively light loads can be applied to the travelling strips A, B. After the strips A, B have been loaded in the machine 15 in the manner mentioned, the first retarding devices 17*a*, 17*b* which are capable of being vertically displaceable with the guide roller 16 are displaced therewith so as to enable the register marks 18*a*, 18*b* to be detected by the sensors 19*a*, 19*b* substantially at the end of each intermittent travel of the film strips A, B.

When the motor 40 of the machine starts rotating, the two strips A, B are intermittently moved for a predetermined distance at a time as previously mentioned. During advance of the strips A, B, it occurs necessarily that one of them goes ahead of the other and the register marks 18*a*, 18*b* are brought into disagreement with each other, due to expansion or contraction of the strips, difference in the amount of slip between the strips A, B slidably nipped between the intermittent rollers 11*a* and 11*b*, etc. . .

Figure 4:
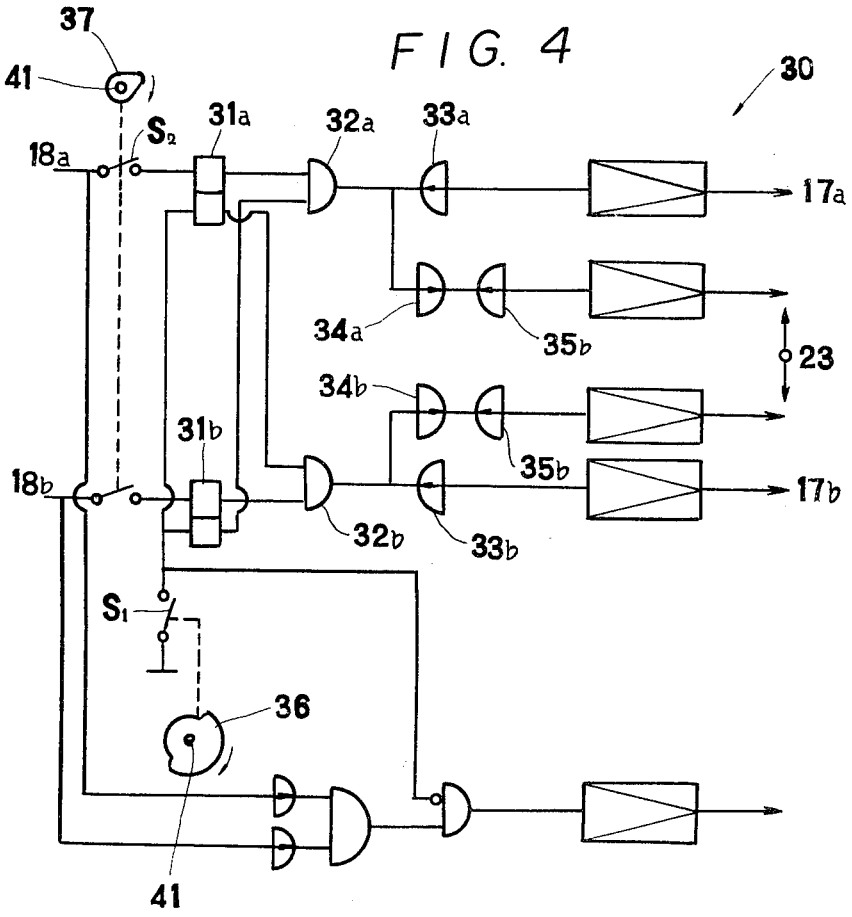
FIG. 4 is a diagrammatic representation, showing one example of logic circuit with control units for a sequential control of the embodiment.
Figure 5:
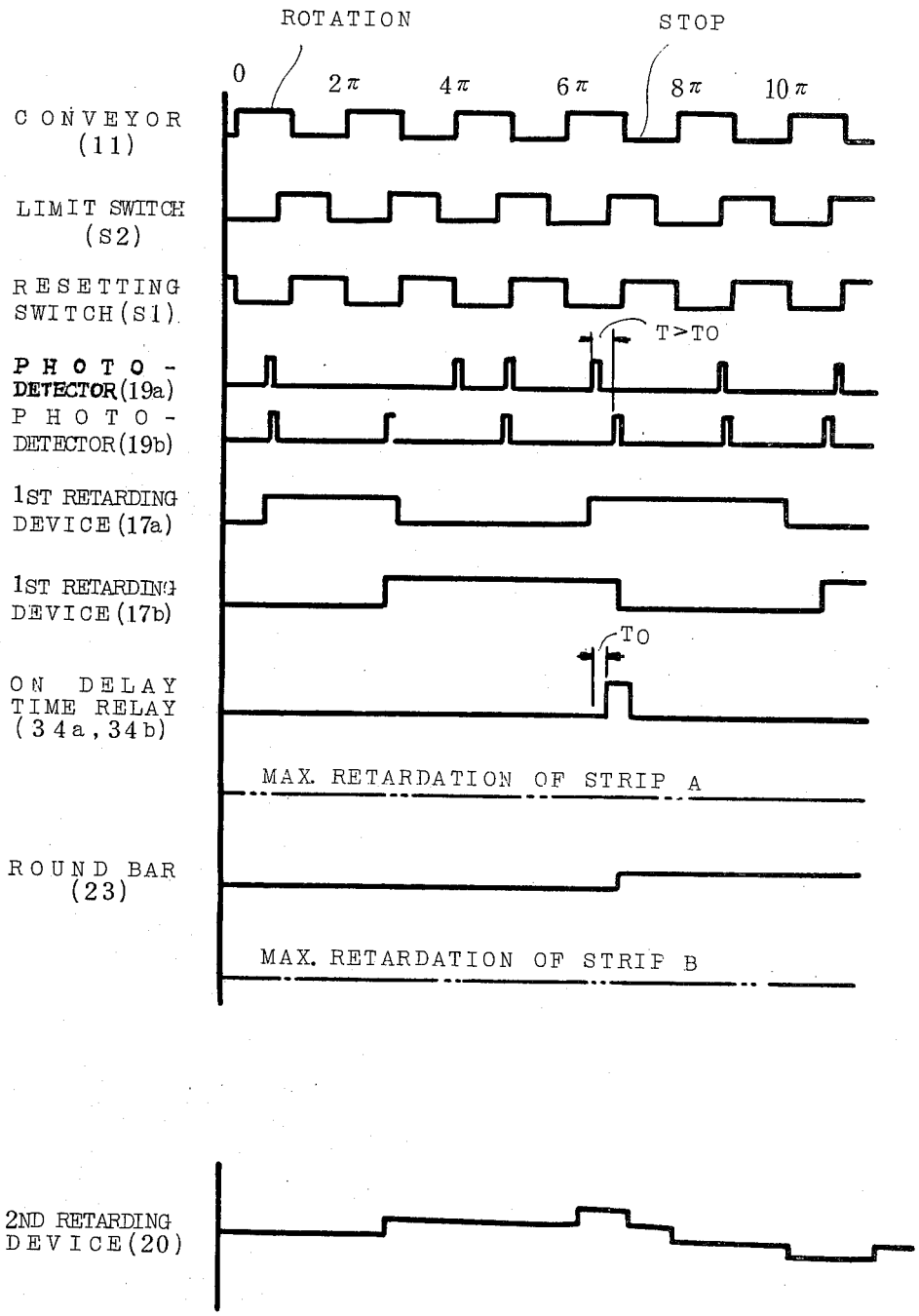
FIG. 5 is a time chart, illustrating the process of operation of the apparatus according to the present invention.

Description will now be directed to the manner of operation of the automatic controlling apparatus of the invention by referring to the drawings, particularly to FIG. 4 showing a suitable control circuit arrangement for the apparatus and FIG. 5 showing the process of the operation of the apparatus.

In the circuit arrangement 30, a resetting switch S1 is kept in "off" position during each intermittent travel of the strips A, B and in "on" position during each inoperative interval of the intermittent rollers 11*a*, 11*b*, and a limit switch S2 for limiting time of operation of the mark detectors 19*a*, 19*b* is to be kept in "on" position during the period of time for the second half of each intermittent travel of the strips and the first half of each inoperative interval of the rollers 11*a*, 11*b*. These switches S1 and S2 are arranged to be operated by cams 36 and 37 which are mounted on the shaft 41 that makes a revolution per the machine cycling.

If and when either one of the strips, for example, a strip A travels ahead of the other strip B and a register mark 18*a* on strip A is detected by the mark detector 19*a*, the signal thereof is transmitted to a flip-flop device 31*a*, and then to an off delay time relay 33*a* by way of an AND-device 32i a, whereby the first retarding device 17*a* is actuated to retard advance of the strip A during the next feeding action of conveyor means 11. Then, as the other mark detector 19*b* detects the register mark 18*b* on the other strip B after said mark detector 19*a* has detected a register mark 18*a* on said strip A, an AND-device 32*b* does not transmit the signal from the detector 19*b* to the other first retarding device 17*b* due to the switching action of a flip-flop device 31*b*, and, at the same time, said first retarding device 17*a* is kept operated by the signal from the detector 19*b* until the off delay time relay 33*a* is opened (see FIG. 5). However, if and when the detector 18*b* first detects a mark 18*b*, advance of the strip B is first retarded by the action of the first retarding device 17*b*, which causes the strip B to slip between the two conveyor rollers 11*a*, 11*b*, in the same processes and manner as mentioned immediately above. In either case, when each intermittent feeding action of the conveyor 11 is finished, the resetting switch S1 is turned to "on" position and the flip-flop devices 31*a*, 31*b* are returned to their original positions.

If and when the time T spent from the time at which a sensor 19*a* detects a register mark 18*a* on a film strip A to the time at which the other sensor 19*b* detects a register mark 18*b* on the other film strip B elapses a predetermined time T0, an on delay time relay 34*a* is turned to "on" position and the signal thereof is transmitted to the second retarding device 20 to actuate the motor 26 which rotates the threaded bars 25*a*, 25*b* which in turn cause the round bar 20 to be upwardly displaced so as to apply load to the film strip A to retard or slow travel thereof. The motor 26 is stopped when the time predetermined by the off delay time relay 35*a* elapses, causing the round bar 23 to be stopped and held on the threaded bars 25*a*, 25*b*. Thus, the round bar 23 makes a step upward. It is desirable that the distance for which the round bar 23 is displaced at a time is several mm to 2 cm long. Similarly, if the sensor 19*b* does not detect a mark 18*b* even after lapse of the predetermined time T0, after the other sensor 19*a* has detected a mark 18*a* and after the resetting switch S1 has been turned to "on" position, the round bar 23 is also caused to be raised, in response to the signal from the switch S1, for one step. As the round bar 23 has thus been raised for one step, the load or retarding force constantly applied to the strip A is correspondingly raised, whereas the load or retarding force constantly applied to the other strip B is lowered, conversely. If and when the sensor 19*b* does not detect a register mark 18*b* within the predetermined time T0 after the other sensor 19*a* has first detected a register mark 18*a* and after the round bar 23 has already been raised for one step, the round bar 23 is caused to be further raised for another step to further raise the retarding force constantly applied to the strip A.

Next, if and when the sensor 19*a* does not detect a mark 18*a* within the predetermined time T0 after the other sensor 19*b* has detected a mark 18*b* and before the resetting switch S1 is turned to "on" position, the motor 26 is caused to be reversed and continues rotating until the time predetermined by an off delay time relay 35*b* elapses, causing the round bar 23 to be lowered for one step. If and when the strip B still advances ahead of the other strip A even after the round bar 23 has been lowered for one step, and the sensor 19*a* does not detect a mark 18*a* within the predetermined time T0 after the sensor 19*b* has detected a mark 18*b*, the round bar 23 is caused to be further lowered for another step.

It is to be noted that although the time T0 to be predetermined by the on delay time relays 34*a*, 34*b* can be freely determined within the period of time between the time when the limit switch S2 is turned to "on" position and the time when the resetting switch S1 is turned to "on" position, it is desirable that the time T0 is determined so that it corresponds to the distance of travel of the strips A, B for 5 to 10 mm. It is desirable that the on delay time relays 34*a*, 34*b* are of the type which can vary the time T0, since the time T0 is closely related with speed of travel of the strips A, B.

It will be understood from the foregoing description that in accordance with the present invention, when the relative positional gaps or discrepancies between the register marks 18*a* on the travelling strip A and the register marks 18*b* on the other travelling strip B are relatively small, such gaps or discrepancies are corrected by the actions of the first retarding devices 17*a*, 17*b* in such a way that the strip A or B advancing ahead of the other strip B or A during each intermittent travel is retarded by the corresponding first retarding device 17*a* or 17*b* during the next feeding action of the intermittent conveyor 11 and that when such gaps or discrepancies are relatively large, they are rapidly corrected by the joint actions of the first and second retarding devices 17*a*, 17*b* and 20, particularly by means of the second retarding device 20 which displaces its round bar 23 in the manner aforementioned, whereby manufacture of defective products can be minimized.

It should be noted that according to the method and apparatus of the present invention, as described, there is no need of frequently applying retarding actions to the strips A, B, since the round bar 23 of the second retarding device 20 is adapted to constantly keep the register marks 18*a*, 18*b* in substantially aligned relationship.

It should be also noted that the second retarding device 20 is simple in structure and operation, free from trouble and can be manufactured at a reasonable cost.

Although the invention has been described in its preferred form, it is understood that the present disclosure of the form has been made only by way of example, and that numeral changes in the details of construction and the combination and arrangement of parts such as the second retarding device and the control circuit arrangement may be made without departing from the spirit and the scope of the invention.

I claim:

1. A method of automatically controlling travel of two transversely spaced parallel plastics film strips in a bag-making machine, packaging machine or the like, which comprises the steps of: moving the film strips, each having register marks at substantially regular intervals, by an intermittently operated conveyor means having a pair of nipping rollers; detecting the marks of the strips respectively by separate photoelectric detectors; and retarding either one of the strips that precedes the other strip during the next feeding action of said conveyor means by means of a first retarding device for the strip which is arranged to be operated in response to detection by one of said detectors of one of the marks of the strip, characterized in that in case where one of the marks of the other strip has not been detected by the other of said detectors within a predetermined time, after detection of one of the marks of the preceding strip, during each intermittent travel of the strips, retarding further the preceding strips and at the same time accelerating the other strip by means of a second retarding device for the strips.

2. An apparatus for automatically controlling travel of two transversely spaced parallel plastics film strips in a bag-making machine, packaging machine or the like, which comprises an intermittently operated conveyor means having a pair of nipping rollers and adapted to intermittently convey such film strips each having register marks at substantially regular intervals, photoelectric detectors provided on the strip-feeding side of said conveyor means and arranged to detect the marks on the strips, separately and first retarding devices provided on the strip-feeding side of said conveyor means and arranged to retard the strips, separately, said first retarding devices being arranged to be operated in response to first detection by one of said detectors of one of the marks on the strips to retard only the strip preceding the other strip during the next feeding action of said conveyor means, characterized by the provision of a second retarding device which is arranged to constantly and relatively impart a retarding force to the strips and to operate such that when the retarding force imparted to one of the strips is stepwise raised, the retarding force imparted to the other of the strips is stepwise lowered, conversely, and in that in case where one of the marks of the strip as preceded by the preceding strip has not been detected by one of said detectors within a predetermined time, after detection of one of the marks of the preceding strip by the other of said detectors, said second retarding device is caused to raise the retarding force imparted to the preceding strip for one step and at the same time to lower the retarding force imparted to the other strip for one step by means of a control circuit arrangement.

3. The apparatus as claimed in claim 2, characterized in that said second retarding device comprises a fixed, round guide bar and a guide roller which define paths of travel of the two strips and a round bar as a retarding member for the strips that extends transversely across said paths between the guide bar and the guide roller and is arranged to be movable stepwise in the direction substantially perpendicular to said paths.

* * * * *